US006550409B1

(12) United States Patent
Smith

(10) Patent No.: US 6,550,409 B1
(45) Date of Patent: Apr. 22, 2003

(54) RAT RING

(76) Inventor: Damon Eugene Smith, 21 Studio Lane, Flatts (BM), FL04

( * ) Notice: Subject to any disclaimer, the term of this patent is extended or adjusted under 35 U.S.C. 154(b) by 0 days.

(21) Appl. No.: 10/273,107

(22) Filed: Oct. 18, 2002

Related U.S. Application Data

(60) Provisional application No. 60/333,501, filed on Nov. 28, 2001.

(51) Int. Cl.[7] ..... B63B 9/00
(52) U.S. Cl. ..... 114/221 R
(58) Field of Search ..... 52/101; 114/221 R

(56) References Cited

U.S. PATENT DOCUMENTS

| | | | | |
|---|---|---|---|---|
| 977,240 A | | 11/1910 | Ward | |
| 1,052,547 A | | 2/1913 | Worthington | |
| 1,641,345 A | | 9/1927 | Mead | |
| 1,709,225 A | | 4/1929 | Mead | |
| 1,744,834 A | | 1/1930 | Maynard | |
| 2,483,874 A | | 10/1949 | Bernhard | |
| 2,950,700 A | | 8/1960 | McBride | |
| 3,362,115 A | | 1/1968 | Nyhus et al. | |
| 3,753,416 A | | 8/1973 | Haglund et al. | |
| 3,872,818 A | | 3/1975 | Salvarezza | |
| 5,293,721 A | * | 3/1994 | Richard et al. | 52/101 |
| 5,497,585 A | * | 3/1996 | Engler | 52/101 |
| 5,570,652 A | | 11/1996 | Ferland | |
| 5,596,834 A | | 1/1997 | Ritter | |
| 5,826,542 A | | 10/1998 | Allen et al. | |
| D413,154 S | | 8/1999 | Wylie et al. | |
| D440,360 S | | 4/2001 | Nylen | |
| D441,922 S | | 5/2001 | Nylen | |

FOREIGN PATENT DOCUMENTS

GB 2 264 622 A 8/1993

* cited by examiner

*Primary Examiner*—Ed Swinehart
(74) *Attorney, Agent, or Firm*—Richard C. Litman

(57) ABSTRACT

A rat ring device to attach to hawsers of moored boats or ships for preventing the boarding of rodents. The device has a spindle with a throughbore to frictionally fit the specific hawser and knobbed ends which retain a rotatable cylinder on the spindle and prevent axial movement of the cylinder on the spindle. The rat is readily spun off when attempting to traverse the device to reach the boat or ship. One of the knobbed ends has a loop for attaching a tag line which is attached to the boat or ship.

12 Claims, 2 Drawing Sheets

RAT RING

CROSS-REFERENCE TO RELATED APPLICATION

This application claims the benefit of U.S. Provisional Patent Application Ser. No. 60/333,501, filed Nov. 28, 2001.

BACKGROUND OF THE INVENTION

1. Field of the Invention

The present invention relates generally to a pest deterrent. More specifically, the invention comprises an attachment device to an anchor rope or hawser rope for boats to prevent rodents from boarding.

2. Description of Related Art

The relevant art of interest describes various pest deterrents, but none discloses the present invention. There is a need for an economical, novel and readily attachable and removable rodent deterrent for preventing the coming onboard of rodents onto a moored boat, either anchored or at a dock, via the anchor rope or docking hawser.

The relevant art of interest will be discussed in the perceived order of relevance to the present invention.

U.S. Design Pat. No. 413,154 issued on Aug. 24, 1999, to John D. Wylie et al. describes a high power line rodent deterrent device comprising five spheres with throughbores placed on a line with circular disks placed between the outermost spheres. The device is distinguishable for requiring spheres and disks.

U.S. Design Pat. No. D440,360 S issued on Apr. 10, 2001, and U.S. Design Pat. No. D441,922 S issued on May 8, 2001, to David Nylen describes an ornamental squirrel baffle comprising a cylindrical body having a throughbore, a rounded or conical end and a flat end. The ornamental devices are distinguishable for their singular structures.

U.S. Pat. No. 5,570,652 issued on Nov. 5, 1996, to Bret Ferland describes a circular rodent guard for an electrical lead wire to a house comprising a circular disk having a radial slit with holes for tying down after installation with tie bands and clamping a centered sleeve on both sides of the disk. The device is distinguishable for requiring a non-rotatable disk.

U.S. Pat. No. 977,240 issued on Nov. 29, 1910, to William S. Ward describes a rat trap positioned on a hawser, comprising two bottom hinged half-sections in the form of half-cylinders with two centered quarter-circle barrier sections which are locked together by a link. The two bottom hinged half-sections are locked by hooks on the hawser. There are four trap doors which are spring-loaded to close. A skid separator is located between two traps in each fore and aft section. The rat must negotiate the first fore traps, the semicircular barrier wall section, and the second aft traps in order to reach the ship. The device is distinguishable for its intricate cage with multiple trap doors, a barrier wall section and skip separators.

U.S. Pat. No. 1,052,547 issued on Feb. 11, 1913, to Hamilton L. Worthington describes a rat trap for use on ship hawsers comprising two bisectioned circular disks supported apart by stays and hinged at one side to lock onto a hawser. Drop doors are provided on each disk. A covering piece or floor is provided between the doors. A spring latch maintains closure of each disk. The rat trap is distinguishable for requiring a cage.

U.S. Pat. No. 1,641,345 issued on Sep. 6, 1927, and U.S. Pat. No. 1,709,225 issued on Apr. 6, 1929, to William A. Mead describe rat guards for hawsers having a similar pincer type structure of two plates. The first patent utilizes two plates, wherein each plate has an area slightly greater than a semicircle. The second patent utilizes two elongated plates. The first patent utilizes arcuate slots and a rivet in the upper part of both plates for alignment. Another rivet proximate the center acts as a pivot. Two pairs of apertures are centrally located for attachment of two cords which are joined. The second patent shares this feature, but has the pivot rivet located at the bottom of both elongated plates along with a locking notch and rivet. Both patents have a centered large opening for the hawser. The devices are distinguishable for requiring a scissors-like pair of plates.

U.S. Pat. No. 1,744,834 issued on Jan. 28, 1930, to Frederick E. Maynard describes a one-piece rat guard for a hawser shaped as an octagon with a radial slit and a centered hole with tongues for attachment to a hinged cylindrical tube member to hold the octagonal plate perpendicular to the hawser. A shutter panel is placed below the hawser on the octagonal plate. The device is distinguishable for requiring a fixed plate.

U.S. Pat. No. 5,826,542 issued on Oct. 27, 1998, to Danny T. Allen et al. describes a frustoconical squirrel baffle assembly for mounting on a power line comprising a disk having a centered opening and a slot extending radially. A sleeve and two collar members are attached to stabilize the baffle disk on the wire. The baffle disk is overlapped at the slot to form a frustoconical baffle on the wire. The device is distinguishable for requiring a baffle disk.

U.S. Pat. No. 2,483,874 issued on Oct. 4, 1949, to Thomas J. Bernhard describes a circular rat guard comprising two overlapping and greater than semicircular half-sections centrally hinged to operate like a folding fan with a central aperture for the hawser. Both sections have an arcuate slot in which an assembling pin is located. An adapter element for the guard requires an indentation in one half-section and is tied to an endless chain on a ring tied further to the ship. Another tying line to the ship is attached to each of the half-sections. The device is distinguishable for requiring semicircular half-sections with numerous rope ties to the ship.

U.S. Pat. No. 2,950,700 issued on Aug. 30, 1960, to J. Le Roy McBride describes a ship's rat guard comprising two substantially circular baffle sections having collars which extend from the hawser hole to proximate the bottom edges. One baffle has a hinged cocking arm to separate the lower portions of the baffle section and rests on the hawser. The cocking arm and hinge can be magnetized. A pin with a compression spring is attached to both baffle sections above the hawser hole to permit separation of the bottom portions to utilize the cocking arm. The device is distinguishable for requiring a two-sectioned baffle.

U.S. Pat. No. 3,753,416 issued on Aug. 21, 1973, to Bernard F. Haglund et al. describes a rat guard for ship hawsers comprising a polygonal barrier plate having a top portion with a vertex formed by two steeply converging edges, a notch reaching to its center from the bottom, and a smaller polygonal portion formed as a self-closing door pivoting on a bolt proximate the center of the barrier plate. Two guide ropes attached to the barrier plate proximate the apex are used to hold the guard in position, and for installing and for withdrawing the guard from the hawser. The device is distinguishable for its plate and locking structure.

U.S. Pat. No. 3,872,818 issued on Mar. 25, 1975, to Robert M. Salvarezza describes a rat guard for ship hawsers comprising a horse head, neck and shoulder shaped barrier plate suspended by two guide ropes to the ship. The barrier plate has a notch or guide slot leading to the center for holding the hawser by locking with a pivoting door having an arcuate slot. The device is distinguishable for its plate and locking structure.

U.S. Pat. No. 3,362,115 issued on Jan. 9, 1968, to Carl D. Nyhus et al. describes an animal deflector for guy wires comprising an elongated hollow cylindrical plastic tube adapted to helically cover a guy wire. The tube is covered with a multiplicity of staples. The device is distinguishable for requiring projecting staples.

U.S. Pat. No. 5,596,834 issued on Jan. 28, 1997, to Vincent A. Ritter describes a rodent exclusion device comprising a flexible strip of material having sharp protruding crowns. The device is distinguishable for requiring sharp crowns.

U.K. Patent Application No. GB 2 264 622 A published on Sep. 8, 1993, for John W. R. Wilson describes a rodent guard shield for mooring ropes comprising a notched circular disk having a spring holding means to secure the rope in the notch at the center of the disk. The device is distinguishable for requiring a circular disc and spring holding means.

None of the above inventions and patents, taken either singly or in combination, is seen to describe the instant invention as claimed.

SUMMARY OF THE INVENTION

The present invention is directed to a pest deterrent device for use on hawsers or anchor ropes of ships or boats to prevent rodents from boarding. The device comprises a free spinning, stainless steel, hollow, cylindrical tube supported by a hollow plastic spindle having knobbed ends to confine the tube. A tag line is attached to a small plastic loop positioned on the conical knob surface of the rat ring proximate to the ship as an additional security to retrieve the rat ring device in the event the hawser or anchor rope breaks inadvertently. The device can have a single piece spindle or a two-piece spindle threadably connected. The device can be supplied in different hole diameters to adapt to various sizes of ropes and hawsers.

Accordingly, it is a principal object of the invention to provide a rodent deterrent device for anchored or docked boats.

It is another object of the invention to provide a rodent deterrent for easy attachment and removal on anchor ropes or hawsers.

It is a further object of the invention to provide a cylindrical device comprising a plastic, two-piece, lockable spindle holding a revolvable metal cylinder.

Still another object of the invention is to provide a rodent deterrent device placed on a rope or hawser to prevent a rodent from entering the boat due to the spinning metal cylinder.

Yet another object of the invention is to provide a tag line attached to the ship and to a small plastic loop positioned on the conical knob surface of the rat ring proximate to the ship as an additional security to retrieve the rat ring device in the event the hawser or anchor rope breaks inadvertently.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
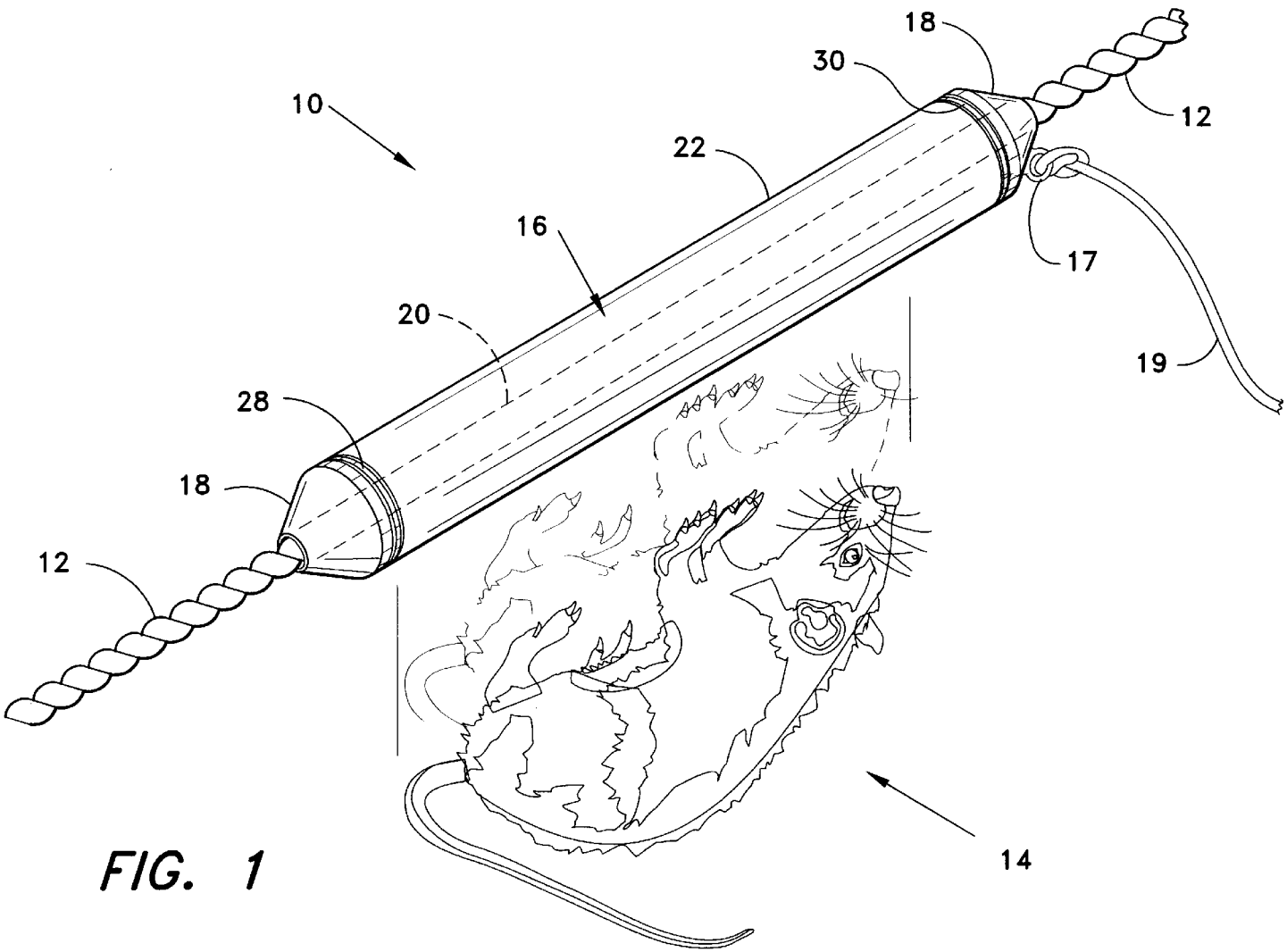
FIG. 1 is an environmental, perspective view of a rat ring device perventing a rat from boarding according to the present invention.
Figure 2:
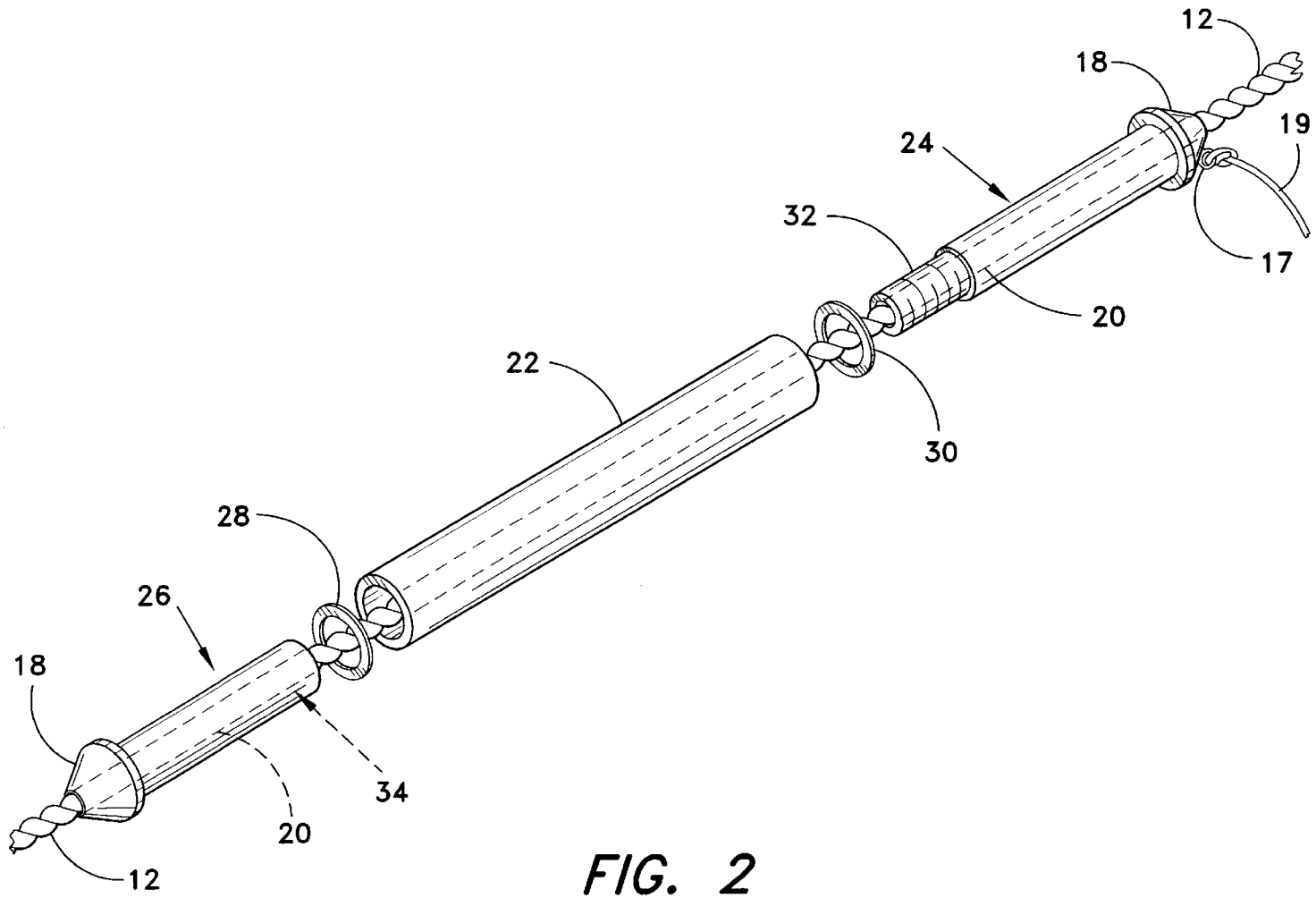
FIG. 2 is an exploded perspective view of the two-piece spindle and the metal cylinder.

The present invention, illustrated in FIGS. 1 and 2, is a rat ring device 10 for positioning on a hawser or rope 12 for preventing a rat 14 from boarding a moored vessel (not shown). The device 10 consists of a plastic, tubular, hollow spindle 16 having knobbed ends 18 and a plastic loop 17 on the knob 18 for attaching a tag line 19 tied to the ship as a security measure. The spindle 16 has a diameter of its throughbore 20 adequate to frictionally remain on the hawser 12. A metal tubular, hollow cylinder 22 adapted to freely rotate on the spindle 16 is confined by the knobbed ends 18, so that the cylinder 22 does not move axially on the spindle 16, but is free to rotate about the spindle 16. The spindle illustrated in the exploded view of FIG. 2 is a two-piece spindle, including two parts 24 (right spindle part) and 26 (left spindle part) with two plastic gaskets 28 (left) and 30 (right) loosely applied, wherein the end of the part 24 has an externally threaded stem 32 to thread into the internal threading 34 at the end of part 26. This is a convenient embodiment to remove the metal cylinder 22 from the spindle 16 for cleaning off accumulated salt and dirt which would prevent the metal cylinder 22 from spinning freely on the spindle 16. The gaskets 28, 30 prevent wear on the plastic knobbed ends 18, and can be replaced readily if worn. As alternative embodiments, the spindle 16 can either be one piece or have one or both knobs removable.

An ascending rat 14 on the hawser 12 would not be able to continue past the rat ring device 10 due to the spinning effect of the metal cylinder 20 on the spindle 16. It is contemplated that the length of the device 10 is made long enough so that the rodent cannot leap over the device. The cylinder 22 is preferably made from stainless steel. The use of plastic material in fabricating the spindle 16 and stainless steel in fabricating the cylinder 22 provides the device 10 with effective corrosion resistance against the effects of fresh and salt water.

Thus, an economical but effective rat deterrent device 10 has been shown for use on any hawser of a moored boat or ship to prevent rodents from ascending the hawser. This device 10 does not injure the rodent, except for a dunking in water.

It is to be understood that the present invention is not limited to the sole embodiments described above, but encompasses any and all embodiments within the scope of the following claims.

I claim:

1. A rat ring device for positioning on hawsers for preventing rats from boarding a vessel, comprising:

an elongated tubular spindle having knobbed ends, the spindle being made from a material having a coefficient of friction adapted for, and having a throughbore dimensioned and configured for, frictionally engaging a hawser in order to remain stationary on the hawser; and an elongated tubular cylinder disposed on the spindle and freely rotatable thereon, the cylinder being disposed between said knobbed ends and prevented from moving axially on the cylinder by said knobbed ends;

whereby a rat ascending the hawser is prevented from continuing past the rat ring device due to rotation of the metal cylinder on the spindle and gravity.

2. The rat ring device according to claim 1, wherein the spindle is formed in two sections threadably connected to each other.

3. The rat ring device according to claim 1, wherein the device is one piece in construction.

4. The rat ring device according to claim 1, wherein one of the knobbed ends is removable from said spindle in order to permit removal of said cylinder for cleaning of the rat ring device.

5. The rat ring device according to claim 1, wherein the knobbed ends is removable from said spindle in order to permit removal of said cylinder for cleaning of the rat ring device.

6. The rat ring device according to claim 1, wherein the spindle is made from plastic.

7. The rat ring device according to claim 1, further comprising a gasket disposed between said cylinder and each of the knobbed ends of said spindle.

8. The rat ring device according to claim 7, wherein the gaskets are loosely applied to prevent wear on the knobbed ends.

9. The rat ring device according to claim 1, wherein the device has a length dimensioned and configured for preventing the rat from leaping over the device.

10. The rat ring device according to claim 1, wherein the cylinder is made from a corrosion resistant metal.

11. The rat ring device according to claim 1, further comprising:

a loop attached to one of the knobbed ends of said spindle; and a tag line having a first end attached to the loop and a second end adapted for attachment to the vessel.

12. The rat ring device according to claim 1, wherein said cylinder is made from stainless steel.

* * * * *